US012559685B2

(12) United States Patent
Kundu et al.

(10) Patent No.: US 12,559,685 B2
(45) Date of Patent: Feb. 24, 2026

(54) METHOD OF PROCESSING TYRES INTO PYROLYTIC OIL QUALITY BY INTRODUCING A CO-FEED

(71) Applicant: Monash University, Clayton (AU)

(72) Inventors: Chandan Kundu, Clayton (AU); Umer Chaudhry, Clayton (AU); Mahmud Arman Kibria, Clayton (AU); Sankar Bhattacharya, Clayton (AU)

(73) Assignee: Monash University, Clayton (AU)

( * ) Notice: Subject to any disclaimer, the term of this patent is extended or adjusted under 35 U.S.C. 154(b) by 66 days.

(21) Appl. No.: 18/551,974

(22) PCT Filed: Mar. 25, 2022

(86) PCT No.: PCT/AU2022/050275
§ 371 (c)(1),
(2) Date: Sep. 22, 2023

(87) PCT Pub. No.: WO2022/198281
PCT Pub. Date: Sep. 29, 2022

(65) Prior Publication Data

US 2024/0174927 A1 May 30, 2024

(30) Foreign Application Priority Data

Mar. 25, 2021 (AU) ..... 2021900888

(51) Int. Cl.
*C10B 53/07* (2006.01)

(52) U.S. Cl.
CPC ..... *C10B 53/07* (2013.01)

(58) Field of Classification Search
CPC ..... C10B 47/06; C10B 53/07; C10G 1/002; C10G 1/08; C10G 1/10
See application file for complete search history.

(56) References Cited

U.S. PATENT DOCUMENTS 10,329,400 B2 * 6/2019 Machon ..... C10B 1/04
2014/0155661 A1 6/2014 Frediani et al.

FOREIGN PATENT DOCUMENTS

PL 235526 8/2020
WO WO 2018/224482 12/2018
WO WO-2018224482 A1 * 12/2018 ..... C07C 4/22

OTHER PUBLICATIONS

WO-2018224482-A1 English Translation (Year: 2018).*

* cited by examiner

*Primary Examiner* — Ellen M McAvoy
*Assistant Examiner* — Chantel Graham
(74) *Attorney, Agent, or Firm* — Levine Bagade Han LLP

(57) ABSTRACT

Disclosed herein is a method for co-pyrolysis of a polyolefin and a rubber containing material comprising: operating at least a pyrolysis stage of a pyrolysis reactor at an operating temperature at or above the temperature at which pyrolysis of both the polyolefin and the rubber containing material commences and up to about 600° C. under a substantially inert atmosphere; feeding a mixture comprising the polyolefin and the rubber containing material into the pyrolysis reactor; co-pyrolysing the mixture in the pyrolysis reactor to produce a pyrolysis gas comprising volatile pyrolysis products of the polyolefin and the rubber, wherein the volatile pyrolysis product of the olefin comprises at least a short chain olefin and the volatile product of the rubber comprises at least a diene; and facilitating a gas phase reaction between the short chain olefin and the diene to produce a volatile gas comprising single-ring aromatic hydrocarbons.

22 Claims, 5 Drawing Sheets

METHOD OF PROCESSING TYRES INTO PYROLYTIC OIL QUALITY BY INTRODUCING A CO-FEED

CROSS-REFERENCE TO RELATED APPLICATIONS

This application is a U.S. national phase application of International Application No. PCT/AU2022/050275 filed on Mar. 25, 2022, which claims priority to Australian Patent Application No. 2021900888 filed Mar. 25, 2021, the contents of which are incorporated herein by reference in their entireties.

FIELD

The invention relates to a method for co-pyrolysis of a polyolefin and a rubber containing material.

BACKGROUND

The extraction of energy and material from waste rubber materials, and in particular tyre waste, has recently gained much attention to drive the circular economy of waste materials. Energy from the waste material can be recovered under the application of heat through gasification, combustion, and pyrolysis. The pyrolysis process involves the breakdown and rearrangement of chemical constituents of the waste rubber material at high temperatures and under inert atmosphere. Hence, waste materials such as rubber can be converted back into raw hydrocarbons.

Pyrolysis of waste rubber materials generally produces oil, gas, and char. The oil and gas products are mainly composed of aliphatic (straight chain), single ring aromatics (SAH), and polycyclic aromatic hydrocarbon (PAH). Aliphatic and SAH compounds are generally desirable, since for example, high SAH content in oil is an indication of a high-octane rating of a fuel. Moreover, SAHs such as benzene, toluene, xylene, styrene, etc. have numerous applications as raw materials in many industrial applications. In contrast, PAH compounds are undesirable since these compounds are highly carcinogenic and/or mutagenic. As such, the presence of PAH in oil or gas decreases the quality and market value of a pyrolytic oil.

It is desirable to provide a process for the pyrolysis of waste rubber material, such as tyre waste, into a pyrolytic oil with higher concentrations of aliphatic compounds and/or SAH compound and/or lower concentrations of PAH compounds than in comparison to conventional pyrolysis processes of the prior art.

It is an object of the invention to address at least one short coming of the prior art and/or provide a useful alternative.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF INVENTION

In one aspect of the invention there is provided a method for co-pyrolysis of a polyolefin and a rubber containing material comprising:

operating at least a pyrolysis stage of the pyrolysis reactor at an operating temperature at or above a temperature at which pyrolysis of both the polyolefin and the rubber containing material commences and up to about 600° C. under a substantially inert atmosphere;

feeding a mixture comprising the polyolefin and the rubber containing material into the pyrolysis reactor;

co-pyrolysing the mixture in the pyrolysis reactor to produce a pyrolysis gas comprising volatile pyrolysis products of the polyolefin and the rubber, wherein the volatile pyrolysis product of the olefin comprises at least a short chain olefin and the volatile product of the rubber comprises at least a diene, and facilitating a gas phase reaction between the short chain olefin and the diene to produce a volatile gas comprising single-ring aromatic hydrocarbons.

By substantially inert atmosphere, it is meant that the co-pyrolysis process is carried out in the pyrolysis stage of the pyrolysis reactor in the presence of a gas or gases that substantially do not react with polyolefin, rubber, or pyrolysis products thereof at the operating temperature. It is preferred that the substantially inert atmosphere is free of gases which may oxidise or otherwise react with the aforementioned. In particular, it is preferred that the substantially inert atmosphere is substantially free of oxygen (although it will be appreciated that the process contemplates the presence of low concentrations of oxygen). More preferably, the substantially inert atmosphere is a nitrogen atmosphere.

The term short chain olefin, which may also be referred to as a short chain alkene, refer to compounds that typically have a chain length of the order of 2 to 4 carbon atoms. By way of example, such short chain olefins are preferably selected from the group consisting of ethylene, propylene, butene and structural isomers thereof. It is preferred that the short chain olefin is a linear short chain olefin.

The term diene refers to organic compounds that include two C═C double bonds. The dienes may be in the form of cumulated dienes in which the double bonds share a common carbon atom (e.g. —C═C═C—), conjugated dienes in which the double bonds are separated by one single bond (e.g. —C═C—C═C—), or unconjugated dienes in which the double bonds are separated by two or more single bonds (e.g. —C═C—C—C═C—). It is preferred that the diene is a conjugated diene. Examples of conjugated dienes include 1,3-butadiene and isoprene.

In an embodiment, the step of feeding the mixture into the pyrolysis reactor comprises feeding the mixture comprising the polyolefin and the rubber containing material into the pyrolysis reactor with the pyrolysis stage of the pyrolysis reactor being at the operating temperature.

In an embodiment, the method further comprises, after the step of facilitating the gas phase reaction, withdrawing the volatile gas from the pyrolysis reactor, and condensing the volatile gas to form a pyrolytic oil.

In an embodiment, the step of facilitating the gas phase reaction is conducted for a period of from about 1 s to about 5 s.

In an embodiment, a mass ratio of polyolefin to rubber containing material in the pyrolysis reactor is selected to produce an excess of the short chain olefin relative to the diene. Preferably, the mass ratio of polyolefin to rubber containing material is about 1:1.5 to about 1.5:1. More preferably, the mass ratio of the polyolefin to rubber containing material is from about 1:1.2 to about 1.2:1. Even more preferably, the mass ratio is from about 1:1.1 to about 1.1:1. Most preferably, the mass ratio is about 1:1.

In an embodiment, the volatile gas and/or pyrolytic oil comprises single-ring aromatic hydrocarbons and poly-ring aromatic hydrocarbons in a ratio of from about 4:1 or greater. Preferably the ratio is from about 8:1. More preferably, the ratio is from about 12:1. Even more preferably, the ratio is from about 16:1. Most preferably the ratio is from about 20:1.

In an embodiment, the pyrolysis reactor comprises at least two stages a first stage being the pyrolysis stage and a second stage configured to receive the pyrolysis gas from the first stage and facilitate the gas phase reaction between the short chain olefin and the diene to form single-ring aromatic hydrocarbons.

In one form of the above embodiment, the second stage is configured to crack long chain olefinic compounds in the mixed pyrolysis gas to provide a source of short chain olefins to facilitate the gas phase reaction.

The second stage of the reactor may be a catalytic cracker or non-catalytic cracker. In forms of the invention where the reactor is a non-catalytic cracker, the second stage is operated at sufficient temperature to crack long chain olefinic compounds and form the short chain olefins (such as ethylene).

In one form of the above embodiment, a residence time of the pyrolysis gas in the second stage is from about 1 s to about 5 s.

In an embodiment, the pyrolysis reactor comprises at least two stages a first stage being the pyrolysis stage and a second stage comprising a fixed bed of catalyst material, the second configured to receive the mixed pyrolysis gas from the first stage and catalyse the production of single-ring aromatic hydrocarbons and/or suppress formation of poly-ring hydrocarbons.

In forms of the above embodiments, the second stage is operated at a temperature of from about 250° C. to about 400° C. Preferably, the second stage is operated at a temperature of from about 300° C. More preferably, the second stage is operated at a temperature of from about 320° C. Alternatively or additionally, the second stage is operated at a temperature of up to 380° C. More preferably, the second stage is operated at a temperature of up to 380° C. Most preferably, the second stage is operated at a temperature of about 350° C.

In one form of the above embodiment, a residence time of the pyrolysis gas in the second stage is from about 1 s to about 5 s.

In an embodiment, the pyrolysis reactor is a continuous pyrolysis reactor, and the method further comprises:

- continuously feeding the mixture of polyolefin and the rubber containing material into the continuous pyrolysis reactor; and
- continuously withdrawing the volatile gas from the pyrolysis reactor after the step of facilitating the gas phase reaction.

In one form of the above embodiment, the continuous pyrolysis reactor comprises a reaction bed into which the polyolefin and the rubber containing material are fed and pyrolysed to ash, and wherein the feed rate of the mixture and an ash removal rate are sufficient to maintain the bed at an operating bed height.

In an embodiment, the volatile gas and/or the pyrolytic oil comprises PAH in a proportion that is less than if the polyolefin and the rubber containing material were separately pyrolysed under the same pyrolysis conditions.

In an embodiment, the volatile gas and/or the pyrolytic oil comprises PAH in an amount of 8 wt % or less. Preferably 5 wt % or less. More preferably 3 wt % or less. Most preferably 2 wt % or less.

In an embodiment, the volatile gas and/or the pyrolytic oil comprises SAH in a proportion that is greater than if the polyolefin and the rubber containing material were separately pyrolysed under the same pyrolysis conditions.

In an embodiment, the volatile gas and/or the pyrolytic oil comprises SAH in an amount of 30 wt % or more. Preferably 32 wt % or more. Most preferably 35 wt % or more.

In an embodiment, the volatile gas and/or the pyrolytic oil further comprises paraffins in an amount of 7.5 wt % or more. Preferably 10 wt % or more. More preferably 12 wt % or more. Most preferably 14 wt % or more.

In an embodiment, the volatile gas and/or the pyrolytic oil further comprises olefins in an amount from about 30 wt % to about 45 wt %.

In an embodiment, the pyrolysis reactor has a vertical orientation, and the method further comprises withdrawing the volatile gas from an upper portion of the pyrolysis reactor.

In an embodiment, the polyolefin is a thermoplastic polyolefin.

In an embodiment, the polyolefin is one or more materials selected from the group consisting of: polyethylene (PE), low-density polyethylene (LDPE), linear low-density polyethylene (LLDPE), very-low-density polyethylene (VLDPE), ultra-low-density polyethylene (ULDPE), medium-density polyethylene (MDPE), high-density polyethylene (HDPE), polypropylene (PP), polymethylpentene (PMP), polybutene-1 (PB-1); ethylene-octene copolymers, stereo-block PP, olefin block copolymers, propylene-butane copolymers, polystyrene, polyvinyl chloride.

In an embodiment, the rubber containing material is shredded tyre. The shredded tyre can comprise natural and/or synthetic rubber. Preferably, the shredded tyre has been treated to substantially remove metal tyre components.

Preferably, the mass ratio of polyolefin to shredded tyre is about 1:1.5 to about 1.5:1. More preferably, the mass ratio of the shredded tyre to rubber containing material is from about 1:1.2 to about 1.2:1. Even more preferably, the mass ratio is from about 1:1.1 to about 1.1:1. Most preferably, the mass ratio is about 1:1.

In an embodiment, the method is substantially carried out under atmospheric pressure conditions.

In an embodiment, the operating temperature is from about 400° C. to about 550° C. Preferably, the operating temperature is from about 430° C. More preferably from about 450° C.

In an embodiment, the step of co-pyrolysing the mixture of the polyolefin and the rubber containing material is carried out in the absence of a catalyst.

In another aspect of the invention there is provided a product formed according to the method according to the first aspect of the invention and/or embodiments and/or forms thereof.

In an embodiment, the product is a pyrolytic oil.

Further aspects of the present invention and further embodiments of the aspects described in the preceding paragraphs will become apparent from the following description, given by way of example and with reference to the accompanying drawings.

DESCRIPTION OF EMBODIMENTS

It will be understood that the invention disclosed and defined in this specification extends to all alternative combinations of two or more of the individual features mentioned or evident from the text or drawings. All of these different combinations constitute various alternative aspects of the invention.

As used herein, except where the context requires otherwise, the term "comprise" and variations of the term, such as "comprising", "comprises" and "comprised", are not intended to exclude further additives, components, integers or steps.

The invention relates to a method for the co-pyrolysis of a rubber containing material (such as tyre waste) with a polyolefin. As discussed in the background section, the pyrolysis of waste rubber materials, such as tyres, converts the waste material into valuable oil and gas products. However, it is desirable to enhance the recovery of aliphatic and SAH compounds and/or reduce concentrations of PAH in the pyrolytic oil. The inventors have found that the concentration aliphatic and/or SAH compounds can be increased and/or the concentration of PAH compounds can be reduced if the waste rubber is co-pyrolysed with a polyolefin.

In particular, the inventors have found that a gas phase reaction between gaseous pyrolysis products of rubber and of polyolefin favours the production of aliphatic and/or SAH compounds and can inhibit the formation of PAH subject to the reaction conditions.

Figure 1:
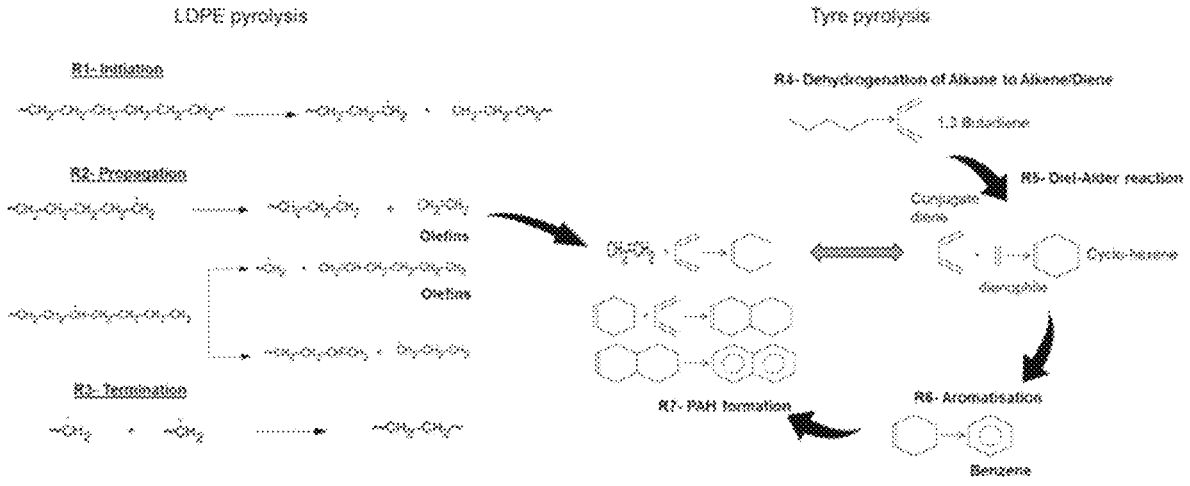
FIG. 1 is a diagram illustrating the reaction pathways for pyrolysis products of tyre waste and LDPE.

The pyrolysis reaction pathways for rubber in the form of tyre scrap and polyolefins in the form of LDPE are generally illustrated in FIG. 1 and are discussed in more detail below.

As illustrated in FIG. 1, pyrolysis of tyre waste is generally initiated by the formation of ethane, propylene, and 1,3 butadiene (R4) which undergo a subsequent Diel-Alder reaction to form cyclohexene (R5). Dehydrogenation of cycloalkenes tends to produce SAHs (R6-aromatisation). SAHs are mainly derivatives of benzene, toluene, and xylenes. The associated secondary reaction of cycloalkenes and SAHs with dienes results in the formation of PAHs. production of dienes and alkenes from pyrolysis of the tyre waste drives the formation of PAHs. Thus, PAHs are a byproduct of conventional pyrolysis reaction pathways for tyre waste.

The inventors have found that it is possible to increase the concentration of SAHs and/or decrease the concentration of PAHs in the pyrolytic oil by increasing the amount of short chain olefins generated during the pyrolysis process. This is because increasing the amount of short chain olefins favours the Diel-Alder reaction to form cycloalkenes whilst consuming available dienes to limit the subsequent conversion of those cycloalkenes to PAHs.

The inventors have found that polyolefin compounds are useful for providing a source of short chain olefins. Whilst a range of polyolefins are contemplated, the discussion below concerns polyethylene materials since these are abundant on a commercial scale. However, based on the disclosure herein, the skilled person will appreciate that a variety of polyolefin materials may be used.

As illustrated in FIG. 1, under pyrolysis conditions, polyethylene undergoes a radical chain mechanism, initiated by random scission of the polymer chain into the free radicals (R1). β-scission of primary radicals leads to lighter alkenes such as ethene (R2). β-scission is then followed by intramolecular hydrogen transfer into more stable secondary radicals (R2). Hence, the β-scission of secondary radical promotes the radical chain mechanism because primary radical is produced in each step (R2-propagation). At higher temperatures, more scission of polymer chain occurs leading to many short primary radicals that react to produce alkanes, and hence favours (R2). The free radicals react to form short chain olefin (R3-termination) e.g. such as ethylene.

In the context of the invention, the co-pyrolysis of a polyolefin such as LDPE as shown in FIG. 1 with the tyre waste generates an abundance of short chain olefins. The same occurs with other polyolefins, such as polypropylene and polyethylene. These short chain olefins react with the diene products of rubber pyrolysis, thus consuming the dienes to produce cycloalkenes. The cycloalkenes are subsequently converted to SAHs. However, the conversion of cycloalkenes to PAHs through reaction with dienes is suppressed due to the lower availability of dienes. That is, the addition of polyolefins such as LDPE, polypropylene, and/or polystyrene as a co-feed with rubber generates short chain olefins which promote the Diel-Alder reaction (R5) to produce cycloalkenes (which are aromatized to SAHs) and given the consumption of dienes, suppresses the subsequent conjugated diene reaction with cyclohexene (R7) thus leading to lower PAH formation.

Aspects and/or features of the invention will be described in more detail below with reference to the Examples.

Example 1

Shredded tyre granules free of steel with length of about 1-3 mm length and thickness of about 0.5-1 mm were co-pyrolyzed with varying ratios of LDPE as a co-reactant in the first stage of a two-stage pyrolysis reactor. For comparative purposes two additional reactions were run with feeds of 100% tyre granules and LDPE respectively.

Figure 2:
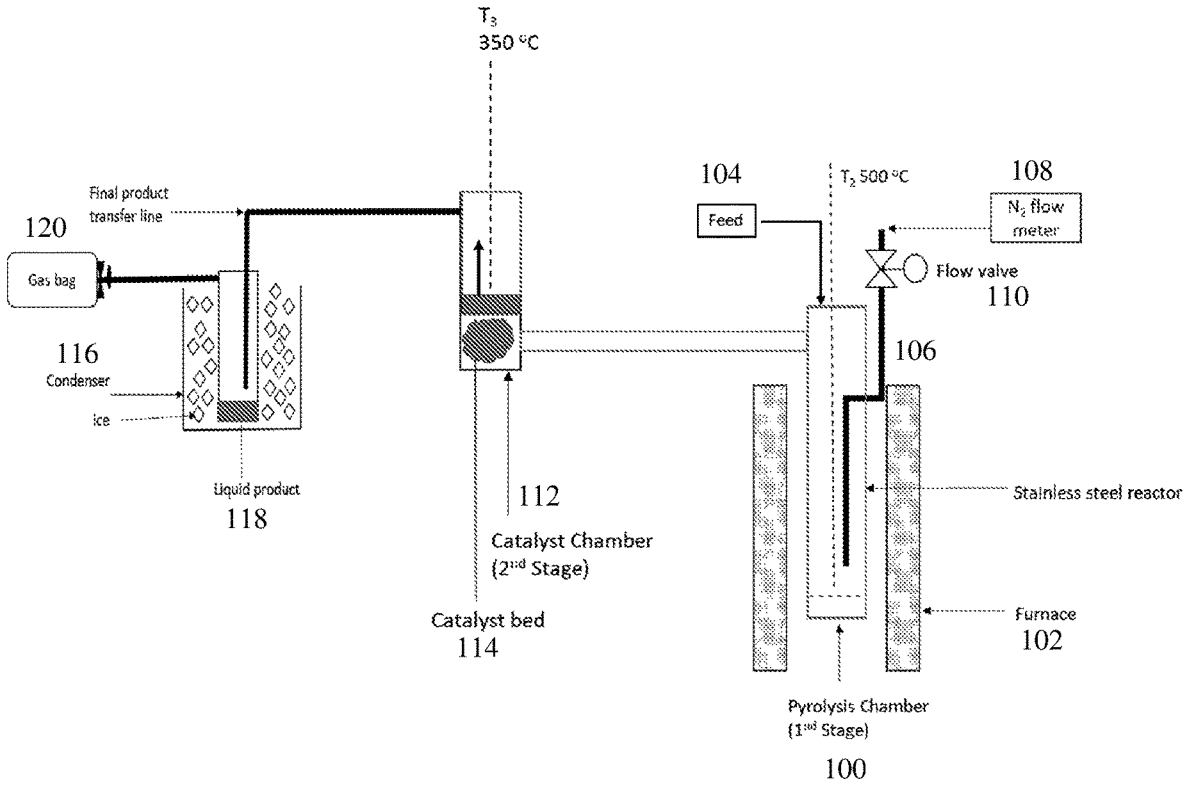
FIG. 2 is a process diagram showing a two stage reactor set up used in the copyrolysis of tyre waste and LDPE.
Figure 3:
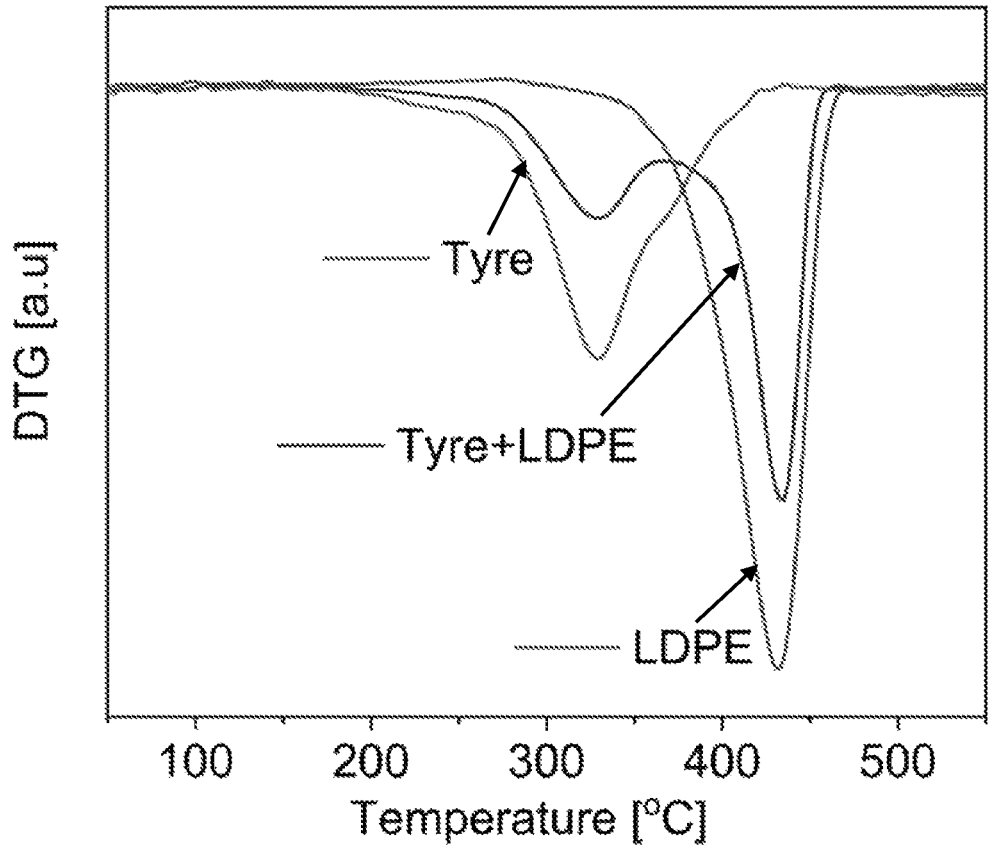
FIG. 3 is a Derivative Thermogravimetry (DTG) curve showing the pyrolysis of (i) tyre waste, (ii) LDPE, and (iii) mixed tyre and LDPE with temperature.

FIG. 2 is a diagram illustrating the process. The process comprises a pyrolysis reactor having a first stage 100 formed from stainless steel which is heated via furnace 102 to an operating temperature sufficient to pyrolyse both the shredded tyre granules and the LDPE. In this particular example, a temperature of 500° C. was selected. The temperature of 500° C. was selected to ensure co-pyrolysis of the tyre granules with the LDPE. FIG. 3 shows that tyre pyrolysis commenced at a temperature of about 300° C. and ends at 400° C. whereas LDPE undergoes pyrolysis at a temperature in the range of from about 400° C. to about 450° C.

The feed 104 was fed into the first stage 100. In the case of co-pyrolysis, a mixed feed comprising shredded tyre granules and LDPE in amounts of 0.40, 0.50, and 0.60, wt % was fed into the first stage 100 of the reactor. After introducing the feed into the first stage 100 of the reactor, the system was purged with $N_2$ for 30 min before increasing the temperature to 500° C. $N_2$ was introduced into the first stage 100 of the reactor via nitrogen flow line 106 comprising flow meter 108 and flow valve 110.

Pyrolytic gases generated in the first stage of the reactor progressed to the second stage 112 of the reactor was maintained at a temperature of 350° C. In this particular embodiment, and contrary to the depiction in FIG. 1, the second stage was a non-catalytic cracking stage for cracking long chain olefins to produce short chain olefins to facilitate the reaction with dienes in the pyrolytic gases to form SAHs and suppress the formation of PAHs. However, in other embodiments (such as that discussed in example 2) the second stage reactor 112 is a catalytic reactor and comprises a catalyst bed 114.

Gases from the second stage 112 of the reactor were subsequently withdrawn from the reactor provided to a condenser 116 and condensed to form a liquid pyrolytic oil 118. Non-condensable gases were collected in a gas bag 120.

The liquid product was analysed via gas chromatography-mass spectrometry (GC MS) using Perkin Elmer Clarus 600 GC/MS equipped with Elite-5 MS capillary column 30 m×0.25 mm. The temperature was ramped at 10° C./min from an initial temperature of 40° C. to a final temperature of 280° C. Holding time of 3 min and 5 min were maintained at the initial and final temperature respectively. The source temperature was 250° C., and the transfer line temperature was 280° C. MS detector mass-range was 20-300 amu.

Figure 4:
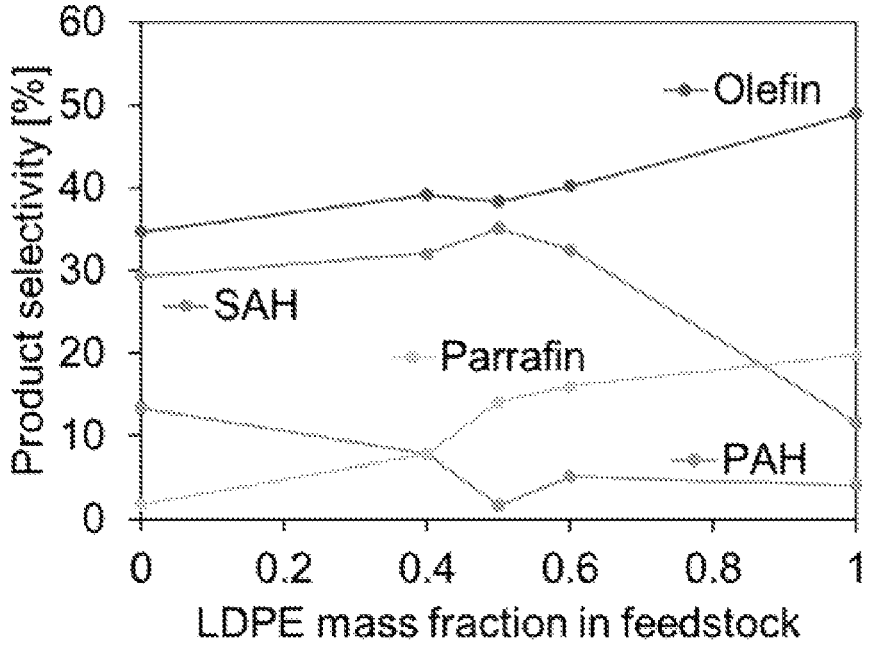
FIG. 4 is a graph showing product selectivity in pyrolytic oil composition obtained from pyrolysis of LDPE and Tyre waste, and co-pyrolysis of blended feeds of LDPE and Tyre waste with 0.4, 0.5, and 0.6 wt % LDPE.

Overall, pyrolysis and co-pyrolysis processes resulted in pyrolytic oils comprising a wide range of paraffinic and olefinic compounds as shown in FIG. 4 and Table 1 below.

TABLE 1

Pyrolytic oil composition from pyrolysis of LDPE and Tyre waste, and co-pyrolysis of blended feeds of LDPE and Tyre waste

| | LDPE:Tyre waste (mass fraction in feed) | | | | |
|---|---|---|---|---|---|
| | 0.00:1.00 | 0.40:0.60 | 0.50:0.50 | 0.60:0.40 | 1.00:0.00 |
| Olefin (wt %) | 34.65 | 39.11 | 38.30 | 40.19 | 48.94 |
| Parrafin (wt %) | 1.78 | 7.78 | 14.13 | 16.05 | 19.79 |
| SAH (wt %) | 29.30 | 32.03 | 35.10 | 32.49 | 11.56 |
| PAH (wt %) | 13.40 | 7.80 | 1.68 | 5.19 | 4.06 |
| SAH:PAH (wt %) | 2.19 | 4.11 | 20.91 | 6.26 | 2.84 |

FIG. 4 shows the liquid product selectivity at different feedstock compositions, plotted as a function of LDPE mass fraction in the feedstock.

Tyre waste is mainly composed of styrene-butadiene, polybutadiene, and natural rubber. These components produce mainly aromatics and aliphatic hydrocarbons when subjected to pyrolysis. In this case, and as shown in FIG. 4 and Table 1, a pyrolytic oil derived from 100% tyre waste feedstock was found to constitute 29.30 wt % SAHs, 34.65 wt % olefins, 1.78 wt % paraffins, and 13.4 wt % PAH.

For a pyrolysis feed of 100 wt % LDPE the resultant pyrolysis oil comprises 48.94 wt % olefins and 19.79 wt % paraffin. Secondary reactions following the Diels-Alder mechanism lead to the formation of SAHs (4.06 wt % in end product), some of which further react to form PAHs (11.56 wt % in end product).

In the case of 0.4 mass fraction of LDPE in the feedstock, the production of both olefin and SAHs was increased and there was a reduction in the production of reduced PAHs. Whereas, paraffin selectivity was significantly increased to 7.8 wt % as compared to only 1.8 wt % in tyre derived pyrolytic oil. Paraffin formation is associated with pyrolysis of the LDPE as discussed above.

The influence of co-pyrolysis on liquid composition was further investigated by increasing the percentage of LDPE in the feedstock. Inclusion of 50% LDPE as a feedstock suppressed the formation of PAH (down to 1.68 wt %) while paraffin and olefin formation increased to 14.13 wt % and 38.3 wt % respectively. The lower PAH content and increased content of olefin and paraffin indicates improved oil quality. Further increasing the proportion of LDPE in the co-feed to 60 wt % led to increased paraffin formation. This is thought to be due to the LDPE cracking mechanism since cracking of long-chain LDPE polymer results in the formation of straight-chain aliphatic hydrocarbons. The radical chain mechanism (initiation, propagation, and termination) favors olefin and paraffin formation and results in negligible aromatic production (e.g. pyrolysis of 100% LDPE feedstock produced only 11.56% SAH).

The purpose of inducing LDPE during the pyrolysis of scrap tyres is to create an olefin rich environment that facilitates the positive synergy between the pyrolytic vapours of two different feedstocks. The proposed reaction mechanism suggests that an olefin rich environment resulted in the reduced formation of polycyclic aromatic hydrocarbons (PAH).

The results show that interaction of tyre granule and LDPE co-pyrolysis vapours has a positive synergistic effect in terms of increasing the concentration of SAHs and decreasing the concentration of PAHs in the resultant pyrolytic oil. This is driven by the pyrolysis mechanisms of tyre granules and LDPE.

Example 2

The experiment of Example 1 was repeated, but this time using a packed bed of a beta zeolite (BEA) catalyst in the second stage of the reactor. BEA zeolite is a microporous crystalline aluminosilicate material with a 12-membered ring and a pore size of 0.64 nm. BEA zeolite catalyst (CP814C) with molar Si/Al ratio 19, was provided by Zeolyst International.

Pyrolytic gases generated in the first stage of the reactor were fed to the catalytic bed in the second stage of the reactor via a transfer line where the pyrolysis vapours react together in the catalyst bed. The temperature of the transfer line and the catalytic bed were maintained at a temperature of 350° C.

The catalytic co-pyrolysis mechanism is relatively complex due to a series of parallel reactions occurring inside the pores of the catalyst. In the catalytic reactor set-up, co-pyrolysis vapours interacted with the BEA zeolite catalyst packed in the second stage. Hence, instead of secondary cracking occurring in the second stage as per Example 1, the pyrolysis vapours were reacted over the BEA zeolite catalyst.

Long-chain aliphatic hydrocarbons from the thermal degradation of the polyolefin in the first stage of the reactor predominantly undergo catalytic cracking in the presence of the catalyst in the second stage of the reactor through two carbocationic mechanisms which ultimately produces short chain olefins. The short chain olefins thereafter react with cyclo-alkene compounds via the Diel-Alder reaction to form SAHs.

The catalyst also catalyzes cyclisation, aromatisation and oligomerisation of olefins and aromatisation and oligomerisation of cycloalkenes to SAHs and PAHs.

Tyre and LDPE derived olefins are also subjected to cyclisation, aromatisation and oligomerisation reactions to obtain aromatics hydrocarbons. Likewise, cyclo-alkene compounds from tyre pyrolysis could individually go through aromatisation and oligomerisation reactions inside zeolite pores to form aromatic hydrocarbons as well.

Figure 5:
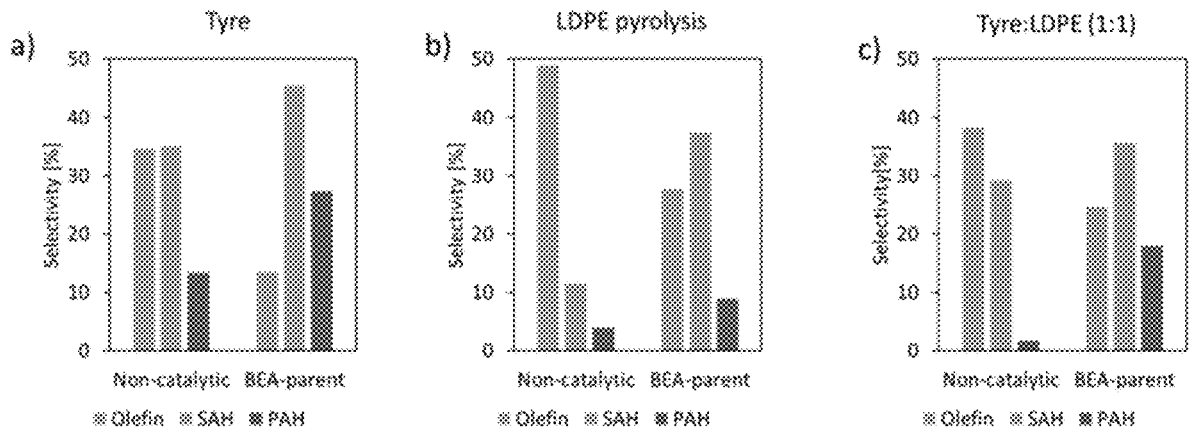
FIG. 5 graphs showing selectivity of olefins, SAHs, PAHs and in a pyrolysis process with a second stage catalytic reactor comprising BEA-zeolite catalyst compared with non-catalytic pyrolysis during a) tyre pyrolysis, b) LDPE pyrolysis and c) a blend of shredded tyre with LDPE. The bars from left to right represent olefins, SAHs, and PAHs.

As shown in FIG. 5*a* and FIG. 5*b* pyrolysis of tyre and LDPE over BEA zeolite catalysts increased the concentration of SAH to 45.4% and 37.4%. However, PAH formation also raised to 27.4% and 8.9% for tyre and plastic pyrolysis respectively. A similar trend was observed during catalytic co-pyrolysis (50% LDPE), PAH formation was jumped to 17.9% from 1.68% (see FIG. 5*c*).

The results show that the production of single-ring aromatic hydrocarbons (SAH) was improved by the inclusion of the BEA zeolite catalyst.

Example 3

The following example reports the results of the co-pyrolysis of a blend of a rubber containing material (shredded tyre waste) with polypropylene (PP) and polystyrene (PS). The blend comprised 50 wt % tyre waste, 25 wt % polypropylene (PP), and 25 wt % Polystyrene (PS).

Figure 6:
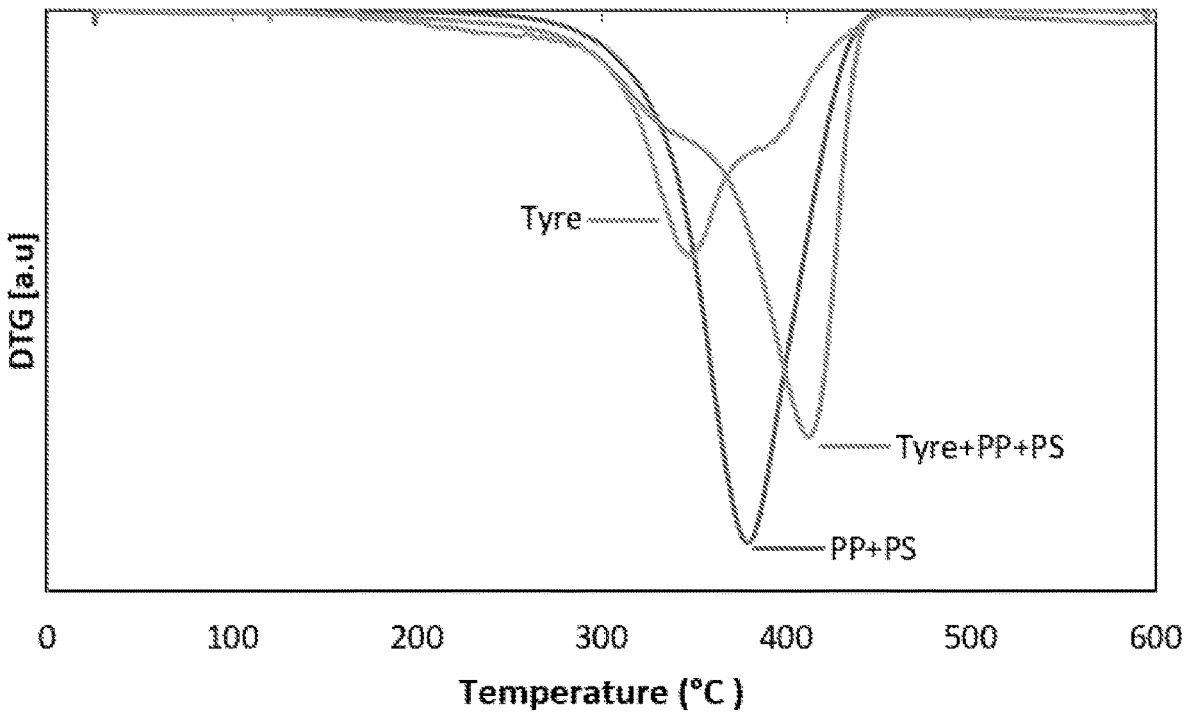
FIG. 6 is a Derivative Thermogravimetry (DTG) curve showing the pyrolysis of (i) tyre waste, (ii) mixed polystyrene and polypropylene, and (iii) mixed tyre, polypropylene, and polystyrene (50:25:25) with temperature.

The operating temperature range for the co-pyrolysis process was identified from the differential thermogravimetry data shown in FIG. 6. The operating temperature range varied from 400° C. to 500° C. The solids residence time in the reactor is generally dependent on the particle size of the tyre material (noting that this takes longer to pyrolyze than an olefin of the same size), in this experiment the particle size was about 5-10 mm and a residence time of about 8 minutes was used. The gas residence time in the reactor is from about 10 s to about 60 s.

The co-pyrolysis reaction was carried out in a reactor similar to that schematically shown in FIG. 2.

Figure 7:
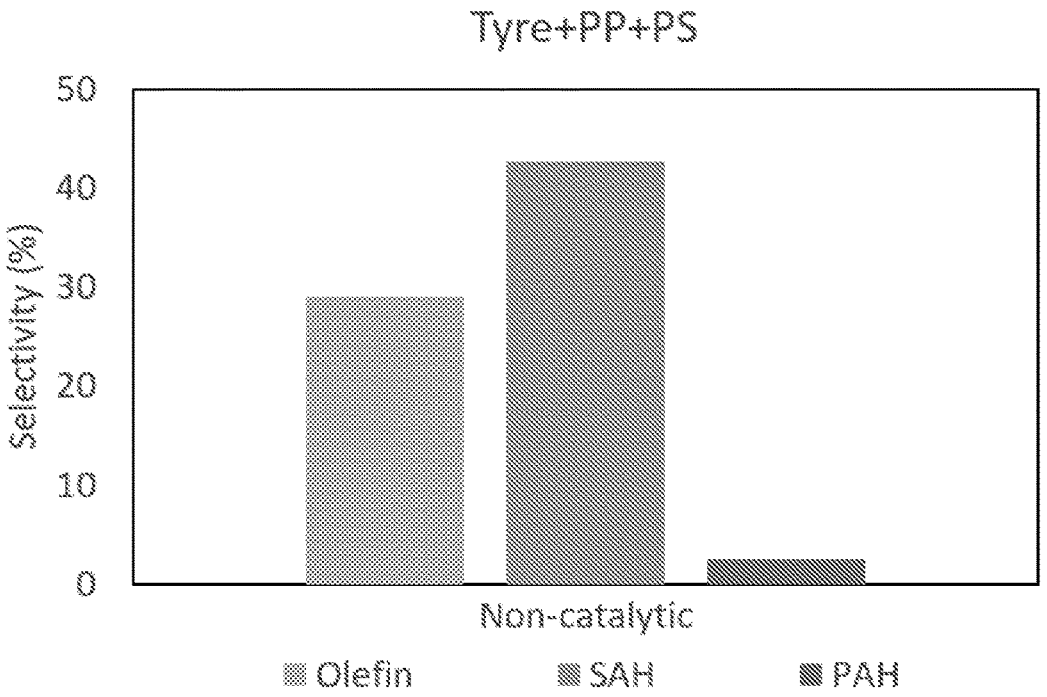
FIG. 7 is a graph showing product selectivity in pyrolytic oil composition obtained from pyrolysis of a blended feed of tyre, polypropylene, and polystyrene (50:25:25). The bars from left to right represent olefins, SAHs, and PAHs.

The results are summarised in Table 2 below and FIG. 7.

TABLE 2

Pyrolytic oil composition from pyrolysis of co-pyrolysis of blended feeds of Tyre waste, PP, and PS

| | Tyre waste:PP:PS (mass fraction in feed) 0.5:0.25:0.25 |
|---|---|
| Olefin (wt %) | 28.90 |
| Parrafin (wt %) | 9.37 |
| SAH (wt %) | 42.71 |
| PAH (wt %) | 2.49 |
| SAH:PAH (wt %) | 17.2 |

The results show that the presence of PP and PS at 25% weight concentration each with 50% tyre results in low PAH and high SAH even with non-catalytic pyrolysis. This suggests that a processing plant can be operated with a mix of tyre and any polyolefin with tyre to provide an oil with high SAH and low PAH—which is a desirable attribute of combustible oil. The oil produced from this experiment was successfully tested in both diesel and petrol engines.

The invention claimed is:

1. A method for co-pyrolysis of a polyolefin and a rubber containing material comprising:

operating at least a pyrolysis stage of a pyrolysis reactor at an operating temperature at or above the temperature at which pyrolysis of both the polyolefin and the rubber containing material commences and up to about 600° C. under a substantially inert atmosphere;

feeding a mixture comprising the polyolefin and the rubber containing material into the pyrolysis reactor;

co-pyrolysing the mixture in the pyrolysis reactor to produce a pyrolysis gas comprising volatile pyrolysis products of the polyolefin and the rubber, wherein the volatile pyrolysis product of the olefin comprises at least a short chain olefin and the volatile product of the rubber comprises at least a diene;

facilitating a gas phase reaction between the short chain olefin and the diene to produce a volatile gas comprising single-ring aromatic hydrocarbons; and wherein a mass ratio of polyolefin to rubber containing material in the pyrolysis reactor is selected to produce an excess of the short chain olefin relative to the diene.

2. The method of claim 1, wherein the mass ratio of polyolefin to the rubber containing material in the pyrolysis reactor is about 1:1.5 to about 1.5:1.

3. The method of claim 1, wherein the volatile gas comprises single-ring aromatic hydrocarbons and poly-ring aromatic hydrocarbons in a ratio of from about 4:1 or greater.

4. The method of claim 1, wherein the pyrolysis reactor comprises at least two stages, a first stage being the pyrolysis stage and a second stage configured to receive the mixed pyrolysis gas from the first stage and facilitate the gas phase reaction between the short chain olefin and the diene to form single-ring aromatic hydrocarbons.

5. The method of claim 4, wherein the second stage is configured to crack long chain hydrocarbons in the mixed pyrolysis gas to provide a source of short chain olefins to facilitate the gas phase reaction.

6. The method of claim 1, wherein the pyrolysis reactor comprises at least two stages a first stage being the pyrolysis stage and a second stage comprising a fixed bed of catalyst material, the second configured to receive the mixed pyrolysis gas from the first stage and catalyse the production of single-ring aromatic hydrocarbons.

7. The method of claim 4, wherein the second stage is operated at a temperature of from about 250° C. to about 400° C.

8. The method of claim 1, wherein the pyrolysis reactor is a continuous pyrolysis reactor, and the method further comprises:

continuously feeding the polyolefin and the rubber containing material into the continuous pyrolysis reactor at the mass ratio; and continuously withdrawing the volatile gas from the pyrolysis reactor after the step of facilitating the gas phase reaction.

9. The method of claim 8, wherein the continuous pyrolysis reactor comprises a reaction bed into which the polyolefin and the rubber containing material are fed and pyrolysed to ash, and wherein the feed rate of the mixture and an ash removal rate are sufficient to maintain the bed at an operating bed height.

10. The method of claim 1, wherein the volatile gas comprises PAH in a proportion that is less than if the polyolefin and the rubber containing material were separately pyrolysed under the same pyrolysis conditions.

11. The method of claim 1, wherein the volatile gas comprises PAH in an amount of 8 wt % or less.

12. The method of claim 1, wherein the volatile gas comprises SAH in a proportion that is greater than if the polyolefin and the rubber containing material were separately pyrolysed under the same pyrolysis conditions.

13. The method of claim 1, wherein the volatile gas comprises SAH in an amount of 30 wt % or more.

14. The method of claim 1, wherein the volatile gas comprises paraffins in an amount of 7.5 wt % or more.

15. The method of claim 1, wherein the volatile gas comprises olefins in an amount from about 30 wt % to about 45 wt %.

16. The method of claim 1, wherein the pyrolysis reactor has a vertical orientation, and the method further comprises withdrawing the volatile gas from an upper portion of the headspace of the pyrolysis reactor.

17. The method of claim 1, wherein the polyolefin is one or more materials selected from the group consisting of: polyethylene (PE), low-density polyethylene (LDPE), linear low-density polyethylene (LLDPE), very-low-density polyethylene (VLDPE), ultra-low-density polyethylene (ULDPE), medium-density polyethylene (MDPE), high-density polyethylene (HDPE), polypropylene (PP), polymethylpentene (PMP), polybutene-1 (PB-1); ethylene-octene copolymers, stereo-block PP, olefin block copolymers, propylene-butane copolymers, polystyrene, polyvinyl chloride.

18. The method of claim 1, wherein the rubber containing material is shredded tyre comprising natural and/or synthetic rubber.

19. The method of claim 1, wherein the method is substantially carried out under atmospheric pressure conditions.

20. The method of claim 1, wherein the operating temperature is from about 400° C. to about 550° C.

21. The method of claim 1, wherein the step of co-pyrolysing the mixture of the polyolefin and the rubber containing material is carried out in the absence of a catalyst.

22. A product formed according to the method of claim 1.

* * * * *